United States Patent [19]

Ezawa

[11] Patent Number: 4,498,364

[45] Date of Patent: Feb. 12, 1985

[54] ELECTRONIC MUSICAL INSTRUMENT

[75] Inventor: Sadaaki Ezawa, Iwata, Japan

[73] Assignee: Kabushiki Kaisha Kawai Gakki Seisakusho, Japan

[21] Appl. No.: 411,337

[22] Filed: Aug. 25, 1982

[30] Foreign Application Priority Data

Aug. 28, 1981 [JP] Japan ..... 56-134906

[51] Int. Cl.[3] ..... G10H 3/06

[52] U.S. Cl. ..... 84/1.17; 84/1.01; 84/1.24; 84/DIG. 4

[58] Field of Search ..... 84/1.01, 1.24, DIG. 4, 84/1.17

[56] References Cited

U.S. PATENT DOCUMENTS 3,854,365 12/1974 Tomisawa et al. ..... 84/1.01

4,184,403 1/1980 Whitefield ..... 84/1.19 X 4,215,616 8/1980 Gross ..... 84/1.01

*Primary Examiner*—Forester W. Isen

*Attorney, Agent, or Firm*—McGlew and Tuttle

[57] ABSTRACT

An electronic musical instrument in which a pair of frequency numbers consisting of a note frequency number corresponding to the pitch of each note and an auxiliary frequency number slightly different from the note frequency number are provided for each note. Only when it is detected that keys of the same note are simultaneously depressed on at least two keyboards, musical waveform signals of slightly different pitches are produced. When keys of different notes are depressed on the individual keyboards, musical sounds of standard pitches can be produced, and only when keys of the same note are concurrently depressed on the individual keyboards, the slightly different frequency numbers are selected, by which variations in the volume of the composite musical sound can be made unnoticeable.

1 Claim, 5 Drawing Figures

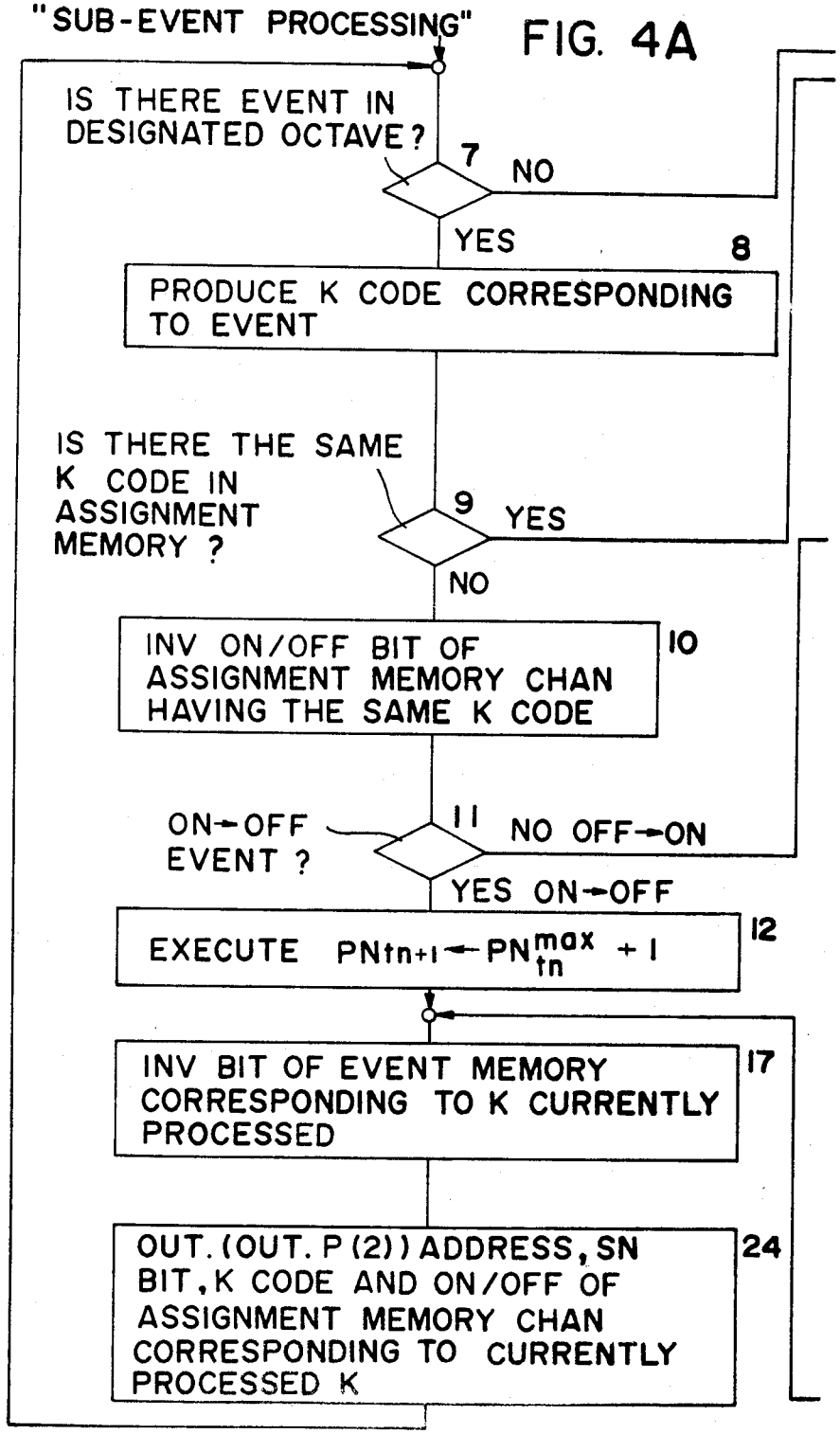
"SUB-EVENT PROCESSING"
FIG. 4A
IS THERE EVENT IN DESIGNATED OCTAVE?
7
NO
YES
8
PRODUCE K CODE CORRESPONDING TO EVENT
IS THERE THE SAME K CODE IN ASSIGNMENT MEMORY ?
9
YES
NO
INV ON/OFF BIT OF ASSIGNMENT MEMORY CHAN HAVING THE SAME K CODE
10
ON→OFF EVENT ?
11
NO OFF→ON
YES ON→OFF
EXECUTE PNtn+1 ← PNtn max + 1
12
INV BIT OF EVENT MEMORY CORRESPONDING TO K CURRENTLY PROCESSED
17
OUT. (OUT. P (2)) ADDRESS, SN BIT, K CODE AND ON/OFF OF ASSIGNMENT MEMORY CHAN CORRESPONDING TO CURRENTLY PROCESSED K
24

ELECTRONIC MUSICAL INSTRUMENT

BACKGROUND OF THE INVENTION

1. Field of the Invention

The present invention relates to an electronic musical instrument which is adapted to prevent, when keys of the same note are depressed on upper, lower and pedal keyboards the generation of, a composite waveform produced according to the timing of the key depression on the keyboards, to cause a change in the volume of the musical sound being produced and thus, creating a disagreeable feeling.

2. Description of the Prior Art

In conventional electronic musical instruments, when keys of the same note are depressed on upper, lower and pedal keyboards, for instance, when keys of a note $C_4$ are depressed on the upper and lower keyboards at different timing, the resulting composite waveforms widely differ according to the timing of key depression as shown in FIGS. 1(*a*) and (*b*). FIG. 1(*a*) shows the case where both musical waveforms produced by the key depression on the upper and lower keyboards have no phase difference therebetween, and FIG. 1(*b*) the case where they are phased 180° apart. In practice, the composite waveform varies at random according to the actual timing of the key depression. Comparison of the composite waveforms in both cases of FIGS. 1(*a*) and (*b*) indicates that, in the former case, the volume is doubled after depressing the key of the note $C_4$ on the lower keyboard (after a time $t_a$), whereas, in the latter case, the volume becomes zero (after a time $t_b$). Accordingly, the player feels unpleasant because the volume varies according to the timing of depressing his or her the keys of the same note on the different keyboards.

As a solution to this problem, there has been proposed, for example, in Japanese Pat. Pub. No. 41499/79 an electronic musical instrument provided with a phasing circuit for retaining musical waveforms in a fixed phase relation so as to prevent the volume of the composite musical sound from varying according to the timing of individual key depressions, but the phasing circuit used is complex in construction. Also there has been proposed, for instance, in U.S. Pat. No. 3,882,751, an electronic musical instrument of the type producing musical waveform signals slightly different in pitch between individual keyboards. For instance, in such a case as of a melody being played on the upper keyboard and a chord on the lower keyboard, their musical notes are produced at subtly different pitches. Furthermore, for example, when a key of a note $C_4$ is depressed on the upper keyboard and a key of a note $C_3$ on the lower keyboard, their musical sounds are produced at pitches which are not spaced exactly one octave apart but have a difference slightly smaller or larger than one octave. This serves to make unnoticeable the variations in the volume caused by the difference in the timing of the key depression. That is to say, when keys of the same note are depressed on different keyboards, musical sounds of subtly different pitches are combined, by which a beat is generated to thereby eliminate the defect that the volume varies according to the timing of the key depression.

However, the electronic musical instrument set forth in the abovesaid U.S. Pat. No. 3,882,751 has the following shortcoming: Namely, one of the two keyboards is set so that its musical sounds are produced at standard pitches, whereas the other keyboard is set so that its musical sounds are produced at pitches slightly different from the standard ones. Accordingly, when keys of the latter keyboard are depressed independently of the former keyboard, musical sounds are generated at pitches a little higher or lower than the standard pitches.

Moreover, keys of different notes are often depressed on different keyboards in actual playing, in which case, according to this conventional electronic musical instrument musical waveforms of slightly different pitches are produced, resulting in the defect that musical sounds of standard and nonstandard pitches are mixed. This rouses an inharmonious feeling in a person who has an acute sense of hearing. In other words, the generation of musical sounds of slightly different pitches gives an impression that a melody and a chord are inharmonious with each other.

SUMMARY OF THE INVENTION

It is therefore an object of the present invention to provide an electronic musical instrument which is adupted so that individual keyboards are set to produce musical notes of standard pitches but when keys of the same note are depressed on different keyboards, the volume of the composite musical sound is averaged by beat.

Briefly states, in the electronic musical instrument of the present invention, a pair of frequency numbers which consists of a note frequency number corresponding to a pitch of a predetermined note and an auxiliary frequency number of a value slightly different from the value of the note frequency number are provided for each predetermined note, and the frequency numbers are selected in accordance with predetermined key information. When it is detected that keys of the same note are simultaneously depressed on at least two keyboards, the note frequency number is selected for the one key and the auxiliary frequency number is selected for the other key. A musical waveform memory is read out based on the selected frequency numbers to generate musical waveform signals of slightly different pitches for the keys of the same note.

When keys of different notes are depressed on at least two keyboards, the note frequency numbers are each selected to produce the note of a standard pitch. Only when keys of the same note are simultaneously depressed on individual keyboards, the note frequency number and the auxiliary frequency number of slightly different values are selected, so that variations in the volume of the composite wave can be made unnoticeable, minimizing the defects described previously in connection with FIGS. 1(*a*) and (*b*).

BRIEF DESCRIPTION OF THE DRAWINGS

FIGS. 3, 4*a* and 4*b* are flowcharts explanatory of the operation of the present invention.

DESCRIPTION OF THE PREFERRED EMBODIMENTS

The principle of the present invention resides in that when keys of different notes are concurrently depressed on different keyboards, standard note frequency numbers are selected, and that when keys of the same note are depressed on individual keyboards at the same time, a note frequency number is selected for the one key and an auxiliary frequency number of a value slightly different from the value of the note frequency number is selected for the other key. In this way, the volume of the composite wave is averaged by beat.

Figure 2:
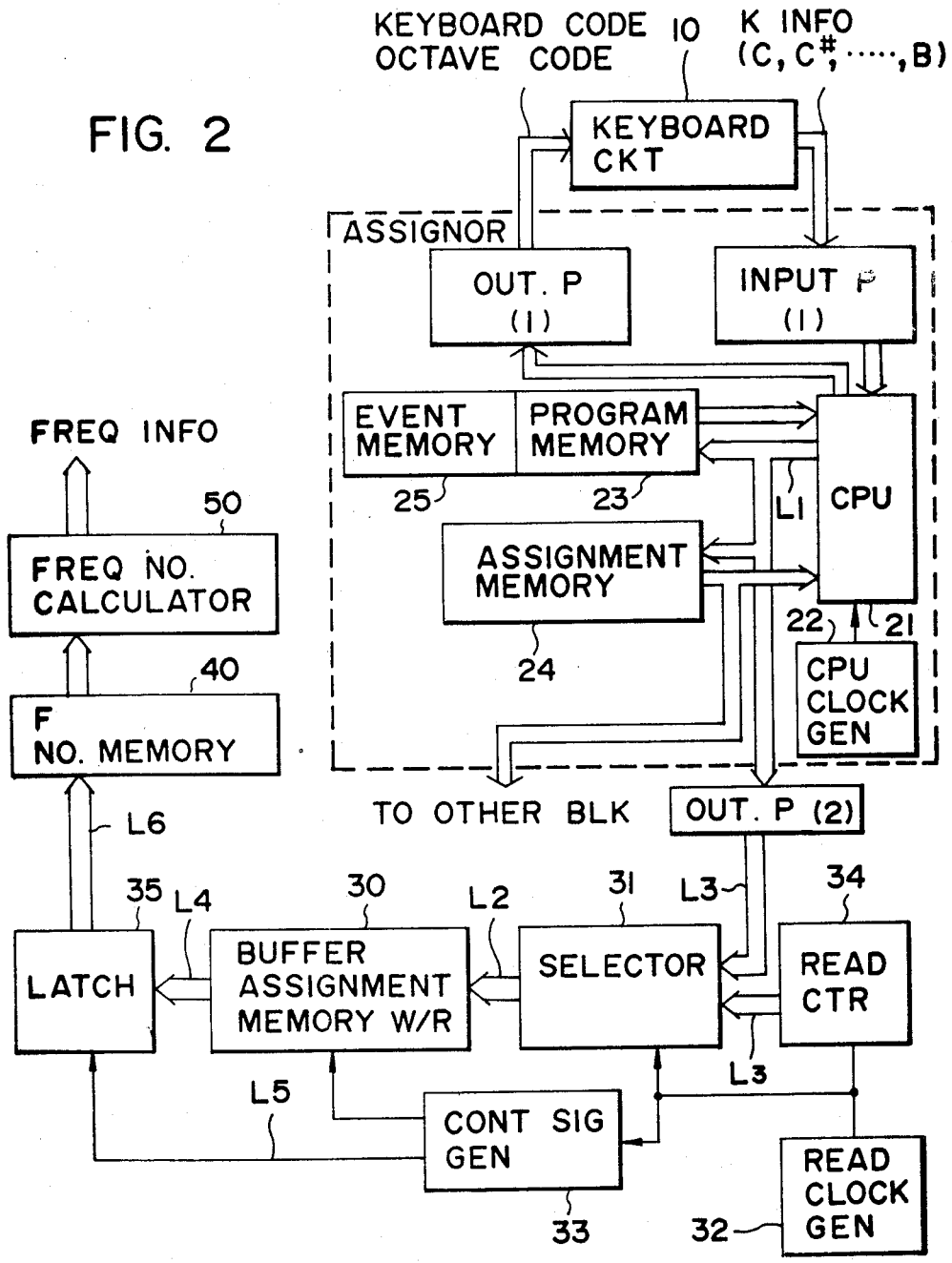
FIG. 2 is a block diagram illustrating the arrangement of an embodiment of the present invention.

FIG. 2 is explanatory of the arrangement of an embodiment of the present invention. In FIG. 2, a keyboard circuit 10 receives from an assignor a five-bit signal including a keyboard code (two bits) indicating an upper, lower or pedal keyboard and an octave code (three bits) indicating a sound range. Based on the five-bit signal the keyboard circuit 10 sends out to the assignor key information (12 bits corresponding to C, C#, D, . . . B) corresponding to a desired octave of a desired keyboard.

Tables 1 and 2 show details of the keyboard code and the octave code, Table 1 being for keyboard bits $DIV_1$ and $DIV_2$ and Table 2 for octave bits $OCT_1$ and $OCT_3$.

TABLE 1

| | $DIV_2$ | $DIV_1$ |
|---|---|---|
| Upper keyboard | 0 | 0 |
| Lower keyboard | 0 | 1 |
| Pedal keyboard | 1 | 0 |

The assignor comprises a CPU 21, a CPU clock generator 22 for driving it, a program memory 23, an assignment memory 24 and an event memory 25.

TABLE 2

| | | $OCT_3$ | $OCT_2$ | $OCT_1$ |
|---|---|---|---|---|
| Octave 7 | $C_7$ to $B_7$ | 1 | 0 | 1 |
| Octave 6 | $C_6$ to $B_6$ | 1 | 0 | 0 |
| Octave 5 | $C_5$ to $B_5$ | 0 | 1 | 1 |
| Octave 4 | $C_4$ to $B_4$ | 0 | 1 | 0 |
| Octave 3 | $C_3$ to $B_3$ | 0 | 0 | 1 |
| Octave 2 | $C_2$ to $B_2$ | 0 | 0 | 0 |

The CPU 21 uses one of its internal registers for generating the keyboard code and the octave code, and increments the value of the register and outputs it via an output port (1) to the keyboard circuit 10. This register will hereinafter be referred to as an OD register. The keyboard circuit 10 immediately delivers key information on a designated keyboard and a designated octave to the assignor. The assignor inputs the key information via an input port (1) and compares it with key information on the corresponding keyboard and octave in the event memory 25 having stored therein key information left at the time of previous scanning, checking whether there is a difference between the current and the previous key information. The difference in this case will hereinafter be referred to as an event. In the case where the ON/OFF state of a keyboard switch is detected to be different from that at the time of previous scanning, the event exists; conversely, when the ON/OFF state is detected to be the same, no event exists. In the absence of any event, the value of the OD register is incremented and provided to the keyboard circuit 10 and the operation proceeds to the next step. When an event is detected, it is checked whether the same key code has already been written in the assignment memory 24 and whether the event is an event of a variation from the ON state to the OFF state or from the OFF state to the ON state. If the event is an event of a key code which has not been written in the assignment memory 24, the key code is written in channels of the assignment memory 24 selecting those in key-released state in accordance with a priority level, making the concerned ON/OFF bit to be an ON signal. If the event is an event of a key code that has not been written in the assignment memory 24, the ON/OFF bit of the channel in which the key code is stored is inverted. After completion of scanning of the upper, lower and pedal keyboards, required contents of the assignment memory 24 are transferred to other blocks, for instance, a musical envelope generator, a musical frequency generator, a musical waveform generator and so forth, though not shown.

In the present invention, when the key code is written in the channels of the keys which are in the OFF state, priority numbers (hereinafter referred to as PN) are used for determining the channel in which the key code is written. For the sake of brevity, Table 3 shows an example of variations in the PN in an assignment memory having a total of four channels. PN=0 indicates that the concerned key is being depressed, and that it is removed from a priority number series. PN=1 indicates channel of the highest priority level and PN=2, PN=3 and PN=4 indicate channels of lower priority levels in this order. In Table 3 the channel of the highest priority level at a time $t_1$ is a channel 1. When a key corresponding to a key code other than the key code stored in the assignment memory at the time $t_1$ is depressed at a time $t_2$, the key code is stored in the channel 1. At the same time, each channel is processed in the following manner in order to advance the order of the priority numbers PN.

TABLE 3

| | Time | | | | | | | | | |
|---|---|---|---|---|---|---|---|---|---|---|
| Channel | $t_1$ | $t_2$ | $t_3$ | $t_4$ | $t_5$ | $t_6$ | $t_7$ | $t_8$ | $t_9$ | . . . |
| channel 1 | 1 | → 0 | → 4 | 3 | 2 | 2 | 2 | → 0 | → 4 | . . . |
| channel 2 | 4 | 3 | 3 | 2 | 1 | 1 | 1 | 1 | 1 | . . . |
| channel 3 | 2 | 1 | 1 | → 0 | → 0 | → 0 | → 4 | 3 | 3 | . . . |
| channel 4 | 3 | 2 | 2 | 1 | → 0 | → 3 | 3 | 2 | 2 | . . . |

Now, let $PNt_n$ represent the priority number of a channel at a time $t_n$ which has not been subjected to key code storing processing and $PN't_n$ represent the priority number of a channel at the time $t_n$ which has been subjected to the key code storing processing. In the case where the keys corresponding to the channels are depressed at a time $t_{n+1}$, the priority number $PN't_{n+1}$ of the processed channel is caused to be a 0, whereas the priority number $PNt_{n+1}$ of the non-processed channel is caused to have a value smaller than $PNt_n$ by 1 when $PNt_n > PN't_n$ and the priority value is retained unchanged when $PNt_n < PN't_n$.

The abovesaid method is represented as follows:

$$PN't_{n+1} \leftarrow 0 \quad (1)$$

$$PNt_{n+1} \leftarrow PNt_n - 1 \ (PNt_n > PN't_n) \quad (2)$$

$$PNt_{n+1} \leftarrow PNt_n \ (PNt_n < PN't_n) \quad (3)$$

Applying the above to the aforementioned table, when the key of the channel 1 is depressed at a time $t_2$, its priority number becomes $PN't_2=0$ according to the indicution (1) and the priority numbers of the other channels each assume a value smaller by 1 than the value at the time $t_1$ according to the indication (2). Next, when the key of the channel 1 depressed at the time $t_2$ is released at a time $t_3$, the musical sound of this channel starts to attenuate, so that the priority number PN of the lowest priority level is stored by execution of the following process:

$$PNt_{n+1} \leftarrow PNt_n^{max}+1 \quad (4)$$

where $PNt_n^{max}$ is the maximum value of the priority number at the time $t_n$. That is, the priority number of the channel 1 assumes a value 4 which is larger by 1 than the value $PNt_2^{max}=3$ at the time $t_2$. In the period from a time $t_4$ to $t_7$ there are shown changes of the priority number in the case where two keys are simultaneously depressed and released. When the same key that was depressed at the time $t_2$ is depressed at the time $t_3$, the key code is not stored in the channel 2 of the most advanced priority level and it is decided that the key code is the same as that left remaining in the channel 1 and the ON/OFF bit of this channel is inverted to an ON signal.

Table 4 shows the contents of the assignment memory 24 closely related to the present invention. A feature of the present invention resides in the provision of a buffer assignment memory 30. The assignment memory 24 is used solely as a data file for the CPU 21, whereas the buffer assignment memory 30 is employed for converting key codes written in the assignment memory 24 into a time series signal. As shown in Table 4, the assignment memory 24 has stored therein an ON/OFF bit, a key code and a priority number PN for each of 14 channels. On the other hand as shown in Table 5, in the buffer assignment memory 30 the priority number PN is not stored because it is not necessary, but instead a same note bit (SN) is added which goes to a "1" when the same note codes are present. This SN bit is similarly added in the assignment memory 24 shown in Table 4.

TABLE 4

| | | Key code | | | | | | | | | | | | | | |
|---|---|---|---|---|---|---|---|---|---|---|---|---|---|---|---|---|
| | | Key-board code | | Octave code | | | Note code | | | | Priority number PN | | | Same note bit | | |
| Address | ON/OFF | $DIV_2$ | $DIV_1$ | $OCT_3$ | $OCT_2$ | $OCT_1$ | $NOTE_4$ | $NOTE_3$ | $NOTE_2$ | $NOTE_1$ | $PN_3$ | $PN_2$ | $PN_1$ | SN | | |
| $A_1$ | 0 | 0 | 0 | 0 | 0 | 0 | 0 | 0 | 0 | 0 | 0 | 0 | 1 | 0 | 1 CH | Upper Key-board CH |
| $A_2$ | 0 | 0 | 0 | 0 | 0 | 0 | 0 | 0 | 0 | 0 | 0 | 1 | 0 | 0 | 2 CH | |
| $A_3$ | 0 | 0 | 0 | 0 | 0 | 0 | 0 | 0 | 0 | 0 | 0 | 1 | 1 | 0 | 3 CH | |
| $A_4$ | 0 | 0 | 0 | 0 | 0 | 0 | 0 | 0 | 0 | 0 | 1 | 0 | 0 | 0 | 4 CH | |
| $A_5$ | 0 | 0 | 0 | 0 | 0 | 0 | 0 | 0 | 0 | 0 | 1 | 0 | 1 | 0 | 5 CH | |
| $A_6$ | 0 | 0 | 0 | 0 | 0 | 0 | 0 | 0 | 0 | 0 | 1 | 1 | 0 | 0 | 6 CH | |
| $A_7$ | 0 | 0 | 0 | 0 | 0 | 0 | 0 | 0 | 0 | 0 | 0 | 0 | 1 | 0 | 1 CH | lower Key-board CH |
| $A_8$ | 0 | 0 | 0 | 0 | 0 | 0 | 0 | 0 | 0 | 0 | 0 | 1 | 0 | 0 | 2 CH | |
| $A_9$ | 0 | 0 | 0 | 0 | 0 | 0 | 0 | 0 | 0 | 0 | 0 | 1 | 1 | 0 | 3 CH | |
| $A_{10}$ | 0 | 0 | 0 | 0 | 0 | 0 | 0 | 0 | 0 | 0 | 1 | 0 | 0 | 0 | 4 CH | |
| $A_{11}$ | 0 | 0 | 0 | 0 | 0 | 0 | 0 | 0 | 0 | 0 | 1 | 0 | 1 | 0 | 5 CH | |
| $A_{12}$ | 0 | 0 | 0 | 0 | 0 | 0 | 0 | 0 | 0 | 0 | 1 | 1 | 0 | 0 | 6 CH | |
| $A_{13}$ | 0 | 0 | 0 | 0 | 0 | 0 | 0 | 0 | 0 | 0 | 0 | 0 | 1 | 0 | 1 CH | Pedal Key-board CH |
| $A_{14}$ | 0 | 0 | 0 | 0 | 0 | 0 | 0 | 0 | 0 | 0 | 0 | 1 | 0 | 0 | 2 CH | |

(CH: channel)

TABLE 5

| | Key Code | | | | | | | | | | | |
|---|---|---|---|---|---|---|---|---|---|---|---|---|
| | | Key-board code | | Octave code | | | Note code | | | | Same note bit | | |
| Address | ON/OFF | $DIV_2$ | $DIV_1$ | $OCT_3$ | $OCT_2$ | $OCT_1$ | $NOTE_4$ | $NOTE_3$ | $NOTE_2$ | $NOTE_1$ | SN | | |
| $A_1$ | 0 | 0 | 0 | 0 | 0 | 0 | 0 | 0 | 0 | 0 | 0 | 1 CH | Upper Key-board CH |
| $A_2$ | 0 | 0 | 0 | 0 | 0 | 0 | 0 | 0 | 0 | 0 | 0 | 2 CH | |
| $A_3$ | 0 | 0 | 0 | 0 | 0 | 0 | 0 | 0 | 0 | 0 | 0 | 3 CH | |
| $A_4$ | 0 | 0 | 0 | 0 | 0 | 0 | 0 | 0 | 0 | 0 | 0 | 4 CH | |
| $A_5$ | 0 | 0 | 0 | 0 | 0 | 0 | 0 | 0 | 0 | 0 | 0 | 5 CH | |
| $A_6$ | 0 | 0 | 0 | 0 | 0 | 0 | 0 | 0 | 0 | 0 | 0 | 6 CH | |
| $A_7$ | 0 | 0 | 0 | 0 | 0 | 0 | 0 | 0 | 0 | 0 | 0 | 1 CH | Lower Key-board CH |
| $A_8$ | 0 | 0 | 0 | 0 | 0 | 0 | 0 | 0 | 0 | 0 | 0 | 2 CH | |
| $A_9$ | 0 | 0 | 0 | 0 | 0 | 0 | 0 | 0 | 0 | 0 | 0 | 3 CH | |
| $A_{10}$ | 0 | 0 | 0 | 0 | 0 | 0 | 0 | 0 | 0 | 0 | 0 | 4 CH | |
| $A_{11}$ | 0 | 0 | 0 | 0 | 0 | 0 | 0 | 0 | 0 | 0 | 0 | 5 CH | |
| $A_{12}$ | 0 | 0 | 0 | 0 | 0 | 0 | 0 | 0 | 0 | 0 | 0 | 6 CH | |
| $A_{13}$ | 0 | 0 | 0 | 0 | 0 | 0 | 0 | 0 | 0 | 0 | 0 | 1 CH | Pedal Key-board CH |
| $A_{14}$ | 0 | 0 | 0 | 0 | 0 | 0 | 0 | 0 | 0 | 0 | 0 | 2 CH | |

(CH: channel)

The addresses in Tables 4 and 5 are set in common thereto. After the CPU 21 writes new data in the assignment memory 24 via a line L1, its address information, ON/OFF, key code and SN bit are output to an output port (2), from which they are delivered via a selector 31 to the buffer assignment memory 30. In this case, the data is written at the timing when the output from a read clock generator 32 is low-level, and the selector 31 selects the output of the output port (2) and outputs it on a line L2. By setting the speed of level inversion of the read clock generator 32 sufficiently higher than the rate at which new data is written in the output port (2), the data is held in the output port (2) for a time long enough to write data in the buffer assignment memory 30. From a control signal generator 33 a signal is derived which makes the buffer assignment memory 30 ready for write only while the selector 31 selects the output of the output port (2), and the signal is applied to a write/read terminal W/R of the buffer assignment memory 30, so that the ON/OFF, the key code and the SN bit latched in the output port (2) are written in the buffer assignment memory 30 in accordance with the address information similarly latched in the output port (2).

Except during the abovesaid operation the buffer assignment memory 30 is held in its readout state. That is, when the output from the read clock generator 32 is high-level, the selector 31 selects the output from a line L3 of a read counter 34 and sends it out on the line L2. Since the buffer assignment memory 30 is in the readout state, data of the upper, lower and pedal keyboard channels are repeatedly read out from the buffer assignment memory 30 on a line L4 in accordance with the count output on the line L3. The read counter 34 may be a 14-step counter because the number of channels used is 14. A latch circuit 35 temporarily stores the data repeatedly read out from the buffer assignment memory 30 by latch pulses provided on a line L5 during the readout operation, by which the influence of the write is obviated. Accordingly, there are developed repetitive time series signals of the ON/OFF, the key code and the SN bit on a line L6.

By the way, it is necessary that the assignor be equipped with the function of detecting that keys concurrently depressed on two keyboards are of the same note. This will be described in respect of the upper and lower keyboards because there is not so much need of adopting such means in connection with the pedal keyboard.

Figure 3:
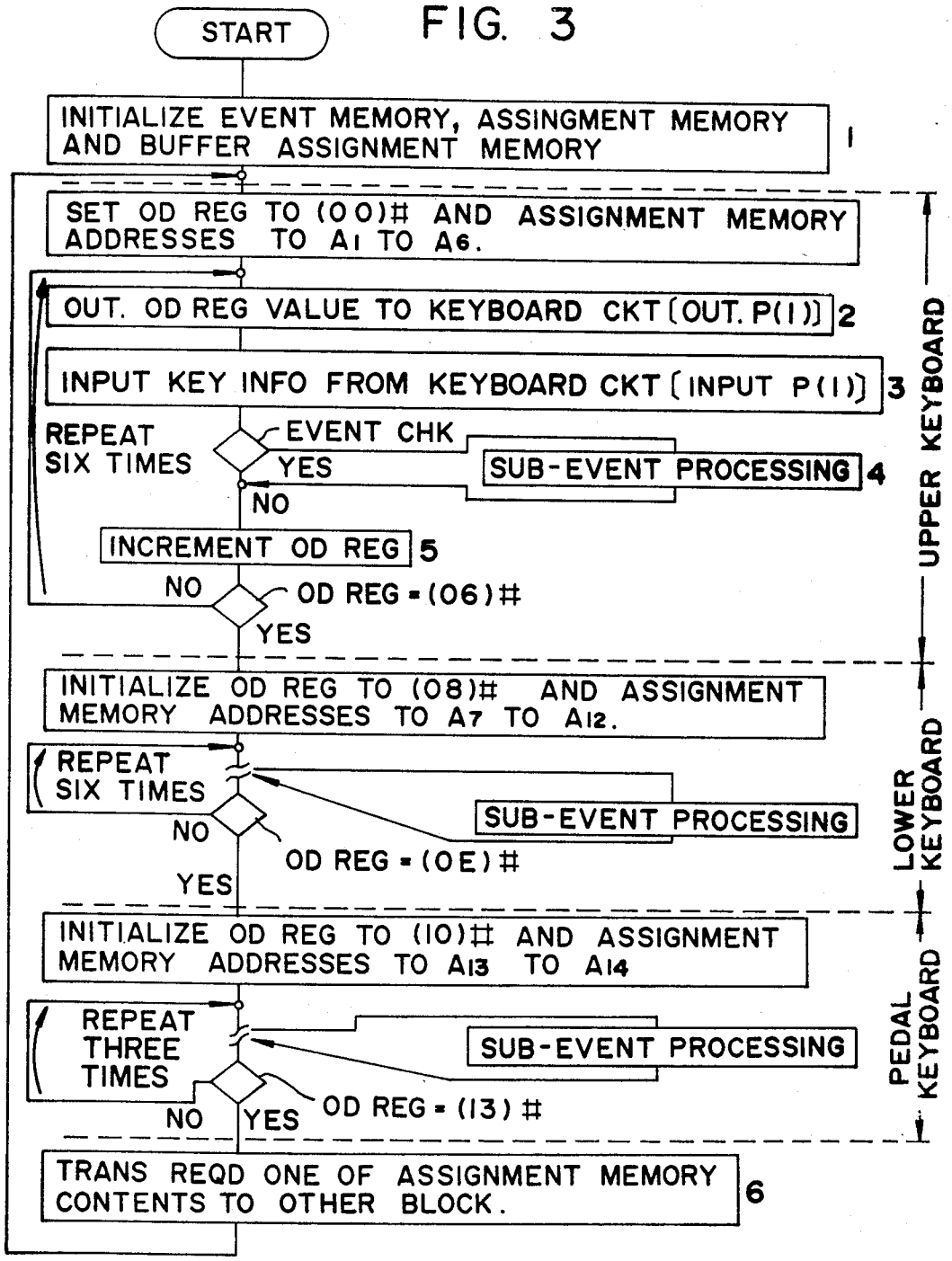

As shown in the flowchart of FIG. 3, in a step 1 the buffer assignment memory, the event memory and the assignment memory are initialized. Then the OD register for producing the keyboard code and the octave code is set to (00)# in the hexadecimal notation. And the address area of the assignment memory 24 is set to an upper keyboard channel (addresses $A_1$ to $A_6$).

Bits of the OD register are arranged as shown below and when the value of the OD register is latched in the output port (1) of the keyboard circuit 10 in a step 2, an upper keyboard octave 2 is designated.

| $b_6$ | $b_5$ | $b_4$ | $b_3$ | $b_2$ | $b_1$ | $b_0$ |
|---|---|---|---|---|---|---|
| .. ..... | ..... | $DIV_2$ | $DIV_1$ | $OCT_3$ | $OCT_2$ | $OCT_1$ |

Key information corresponding to the upper key octave 2 is input via the input port (1) from the keyboard circuit 10 in a step 3 and is subjected to exclusive ORing with the previous key information stored in the event memory 25, effecting an event check. If all results are "0", it indicates the absence of an event, and when one result is at "1", it means the presence of an event and the operation proceeds to a step 4 for "sub-event processing". In the absence of an event, the operation proceeds to a step 5, in which the value of the OD register is incremented to make preparations for designating the next octave. If the incremented value is (06)# corresponding to an octave 8 of the upper keyboard, then it indicates the completion of scanning of the upper keyboard and scanning of the lower keyboard is initiated. If not, the operation returns to the step 2 in which the value of the OD register incremented for designating the next octave is latched in the output port (1) for the keyboard circuit 10. In the case of the lower keyboard, the same procedure as mentioned above is applied to lower keyboard channels ($A_7$ to $A_{12}$) and, in the case of the pedal keyboard, the same procedure is applied to a pedal keyboard channels ($A_{13}$ to $A_{14}$).

Assuming that the upper keyboard covers six octaves, the lower keyboard six octaves and the pedal keyboard three octaves, scanning must be carried out 15 times for processing all the keys. Finally, in a step 6, required ones of the contents of the assignment memory 24 are transferred to other blocks. If the operation does not pass through "sub-event processing" in the 15 scannings, then the step 4 need not be executed. No description will be given of the content of the step 6 since it is not directly related to the present invention.

Figure 4B:
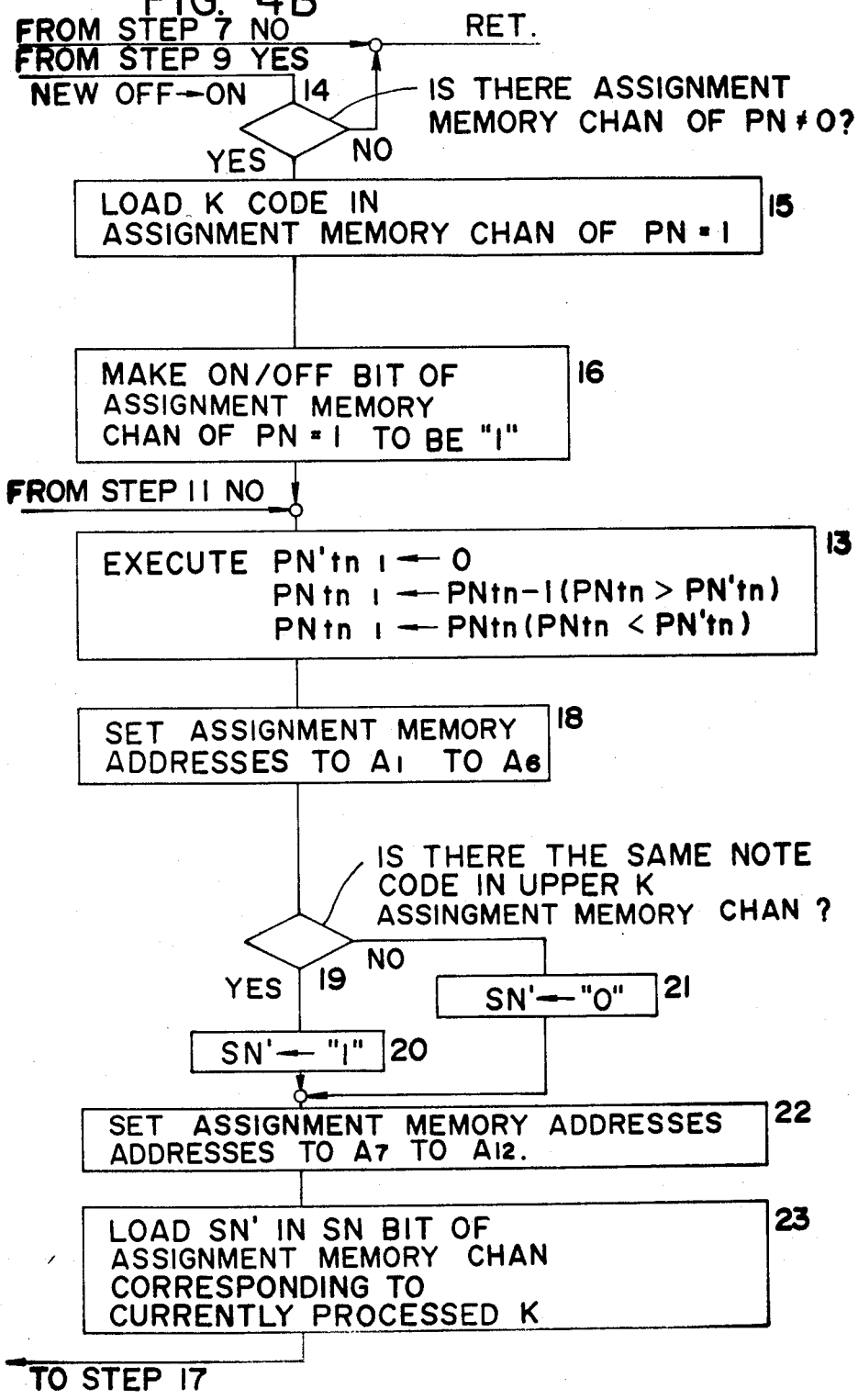

FIGS. 4A and 4B together are a flowchart showing in detail sub-event processing of the upper and lower keyboards. FIG. 4A shows steps 7 to 12, 17 and 24. FIG. 4B shows steps 14 to 16, 18, 19 and 20 to 23. If the result of the exclusive ORing of the key information input from the input port (1) with the corresponding previous key information stored in the event memory contains "1", the operation jumps to the sub-event processing. In the case where a plurality of events are concurrently detected, "1"s of the same number of the events are present in the result of an event check. Since it is one event that is processed by one processing from a step 7 to 17, the operation goes back to the process 7 after the process of the step 17 is completed in a manner to process a plurality of events. It is a step 18 et seq. that constitute the principal part of the present invention, and this will be described later. In the step 7 it is checked whether there is in a designated octave an event or events left unprocessed. If no event is detected, then it indicates that processing of all events are completed, and the operation returns to a main routine. When an event is detected in the designated octave, the key code corresponding to the event is produced in the step 8. Of the key codes, the keyboard code and the octave code can be obtained by using those in the value of the OD register. The note code can be produced by counting the position of the event in 12 bits corresponding to key information C, C#, D, . . . B. Next, in the step 9, it is checked whether the same key code exists in the concerned area of the assignment memory 24. If not, it means the depression of a new key the information of which is not stored in the assignment memory 24, and the operation proceeds to the step 14. Alternatively, the key corresponding to the key code remaining in the assignment memory 24 is released or depressed again, and the operation proceeds to the step 10.

Since the occurrence of an event means that a key in the ON state is altered to the OFF state, and that a key in the OFF state is altered to the ON state, the ON/-OFF bit in the channel having the same key code is inverted in the step 10. Of course, the key code need not be changed. In the step 11 it is decided whether the event caused by the inverted ON/OFF bit is a change from the ON state to OFF state or from the OFF state to ON state. If the inverted ON/OFF bit is at a "0" corresponding to an OFF signal, the event is the change from the ON state to the OFF state and the operation proceeds to the step 12, whereas if the ON/OFF bit is at a "1" corresponding to an ON signal, then the event is the change from the OFF state to the ON state and the operation proceeds to the step 13. In the steps 12 and 13, the correction of the priority level is performed as described in detail in respect of the indications (1) to (4). Thus the processing of the events is completed, and the bits of the event memory 25 corresponding to the keys processed in the step 17 are inverted, thereby to prevent that an event is seized until a new state develops in the processed keys.

In the case where the operation goes to the step 14, it means the depression of a new key the information of which is not stored in the concerned area of the assignment memory 24, so that it is decided in the step 14 whether there is a channel of PN≠0 in which the key is in its released state. If the priority numbers of the concerned channels are all at a "0" indicating the key depression, then the operation returns to the main routine. That is, when the number of keys being depressed is larger than the maximal number of simultaneous tone productions, the key depression which does not produce any tone is always checked as an event and the operation proceeds to the "sub-event processing". And when the key producing a tone is released to provide a channel of PN≠0, the operation which has returned to the main routine proceeds to the step 15, in which the key code is loaded in the channel. When one channel is in the key released state, there is always a channel of PN=1, so that the key code is loaded in the channel of PN=1 in the step 15. Since the event in this case is always an event from the OFF state to the ON state, the ON/OFF bit of the channel of PN=1 is caused to go to a "1" corresponding to the ON state in the step 16. The subsequent steps 13 and 17 are the same as those described previously.

A description will be given of the step 18 et seq. which constitute the principal part of the present invention. FIG. 4 shows the case of the lower keyboard.

In FIG. 4 the feature of the present invention resides in the inclusion of steps 18 to 24. After the step 13, the assignment memory address is modified in the step 18 and, in the step 19, it is checked whether a key of the same note code as the key code corresponding to the event is depressed on the other keyboard. If such a key exists, then the bit SN′ used as a flag is made a "1" in the step 20 and if not, then the bit SN′ is made a "0" in the step 21 and the assignment memory address is restored to the previous one in the step 22. In the step 23 the bit SN′ is loaded in the SN bit of the assignment memory channel corresponding to the currently processed key. In the step 24 the ON/OFF bit, the key code, the SN bit and and address of the assignment memory channel corresponding to the currently processed key are output to the output port (2). FIG. 4 shows the case of the lower keyboard but, in the case of the upper keyboard, in the step 18 "$A_1$ to $A_6$" is changed to "$A_7$ to $A_{12}$", in the step 19 "the upper keyboard" is changed to the "lower keyboard" and in the step 22 "$A_7$ to $A_{12}$" is changed to "$A_1$ to $A_6$".

Referring again to FIG. 2, an F number memory 40 is an ordinary one having an eight-bit output and the frequency number is set to 16 bits. The contents of the F number memory 40 are shown below in Table 6.

TABLE 6

| Address | | | | | | | | | |
|---|---|---|---|---|---|---|---|---|---|
| $A_8$ | $A_7$ | $A_6$ | $A_5$ | $A_4$ | $A_3$ | $A_2$ | $A_1$ | $A_0$ | F number stored |
| 0 | 0 | 0 | 0 | 0 | 0 | 1 | 0 | 0 | High-order 8 bits of $C_2$, note frequency No. |
| 0 | 0 | 0 | 0 | 0 | 0 | 1 | 0 | 1 | Low-order 8 bits of $C_2$, note frequency No. |
| 0 | 0 | 0 | 0 | 0 | 0 | 1 | 1 | 0 | High-order 8 bits of $C_2$, auxiliary frequency No. |
| 0 | 0 | 0 | 0 | 0 | 0 | 1 | 1 | 1 | Low-order 8 bits of $C_2$, auxiliary frequency No. |
| 0 | 0 | 0 | 0 | 0 | 1 | 0 | 0 | 0 | High-order 8 bits of $C\#_2$, note frequency No. |
| 0 | 0 | 0 | 0 | 0 | 1 | 0 | 0 | 1 | Low-order 8 bits of $C\#_2$, note frequency No. |
| 0 | 0 | 0 | 0 | 0 | 1 | 0 | 1 | 0 | High-order 8 bits of $C\#_2$, auxiliary frequency No. |
| 0 | 0 | 0 | 0 | 0 | 1 | 0 | 1 | 1 | Low-order 8 bits of $C\#_2$, auxiliary frequency No. |
| | | | | . | | | | | . |
| | | | | . | | | | | . |
| | | | | . | | | | | . |
| | | | | . | | | | | . |
| | | | | . | | | | | . |

In the above, high-order eight bits are loaded in the address in which the least significant bit of the address signal is at a "0", and low-order eight bits are loaded in the address in which the least significant bit of the address signal is at a "1". A frequency number calculator 50 which cooperates with the F number memory 40 is disclosed in detail in U.S. patent application Ser. No. 324,849 assigned to the same assignee of the subject application. In the frequency number calculator 50 a ROM $N_H$,$N_L$ select signal is connected to the least significant bit address $A_0$ of the F number memory 40. In the address in which the bit $A_1$ of the address signal is at a "0", the note frequency number corresponding to a standard pitch is loaded and in the channel in which the bit $A_1$ of the address signal is at a "1", the auxiliary frequency corresponding to a pitch slightly different from the standard pitch is loaded, so that the same note bit (SN bit) is connected to address $A_1$.

Table 7 shows an example of the formation of note codes obtained by counting the positions of events in 12 bits corresponding to the key information C, C#, D, . . . B.

TABLE 7

| | $NOTE_4$ | $NOTE_3$ | $NOTE_2$ | $NOTE_1$ |
|---|---|---|---|---|
| B | 1 | 1 | 0 | 0 |
| A# | 1 | 0 | 1 | 1 |
| A | 1 | 0 | 1 | 0 |
| G# | 1 | 0 | 0 | 1 |
| G | 1 | 0 | 0 | 0 |
| F# | 0 | 1 | 1 | 1 |

TABLE 7-continued

| | $NOTE_4$ | $NOTE_3$ | $NOTE_2$ | $NOTE_1$ |
|---|---|---|---|---|
| F | 0 | 1 | 1 | 0 |
| E | 0 | 1 | 0 | 1 |
| D# | 0 | 1 | 0 | 0 |
| D | 0 | 0 | 1 | 1 |
| C# | 0 | 0 | 1 | 0 |
| C | 0 | 0 | 0 | 1 |

To the bits $A_5$, $A_4$, $A_3$ and $A_2$ of the address signal are connected the note codes of the key code shown in Table 7, $NOTE_4$, $NOTE_3$, $NOTE_2$ and $NOTE_1$, respectively. To the bits $A_8$, $A_7$ and $A_6$ of the address signal are connected to octave codes of the key code, $OCT_3$, $OCT_2$ and $OCT_1$, respectively. The address in which the note codes $NOTE_4$, $NOTE_3$, $NOTE_2$ and $NOTE_1$ are 1101, 1110 and 1111 are not used. By this, the auxiliary frequency number is read out for the channel in which the SN bit is at a "1", and the note frequency number is read out for the channel in which the SN bit is at a "0".

In the foregoing embodiment the auxiliary frequency number common to the upper and lower keyboards is used, but it is also possible to employ different auxiliary frequency numbers by a similar method.

For instance, the $SN_U$ bit is used for the upper keyboard, and $SN_L$ bit is for the lower keyboard, and an $SN_U$, $SN_L$ bits are prepared in the assignment memory 24 and the buffer assignment memory 30.

In this case, in the flowchart of FIG. 4 SN in the steps 23 and 24 is changed to $SN_U$ in the sub-event processing of the upper keyboard and to $SN_L$ in the sub-event processing of the lower keyboard.

Table 8 shows the contents of the F number memory 40 in this case, To the address bit $A_0$ is connected to a ROM $N_H$,$N_L$ select signal; to the address bit $A_1$ is connected the $SN_U$ bit; to the address bit $A_2$ is connected the $SN_L$ bit; to the address bits $A_6$, $A_5$, $A_4$ and $A_3$ are connected the note codes $NOTE_4$, $NOTE_3$, $NOTE_2$ and $NOTE_1$, respectively; and, to the address bits $A_9$, $A_8$ and A are connected the octave codes $OCT_3$, $OCT_2$ and $OCT_1$, respectively.

TABLE 8

| Address | | | | | | | | | | |
|---|---|---|---|---|---|---|---|---|---|---|
| $A_9$ | $A_8$ | $A_7$ | $A_6$ | $A_5$ | $A_4$ | $A_3$ | $A_2$ | $A_1$ | $A_0$ | F numbers stored |
| 0 | 0 | 0 | 0 | 0 | 0 | 1 | 0 | 0 | 0 | High-order 8 bits of $C_2$, note frequency No. |
| 0 | 0 | 0 | 0 | 0 | 0 | 1 | 0 | 0 | 1 | Low-order 8 bits of $C_2$, note frequency No. |
| 0 | 0 | 0 | 0 | 0 | 0 | 1 | 0 | 1 | 0 | High-order 8 bits of $C_2$, auxiliary frequency No. for upper keyboard |
| 0 | 0 | 0 | 0 | 0 | 0 | 1 | 0 | 1 | 1 | Low-order 8 bits of $C_2$, auxiliary frequency No. for upper keyboard |
| 0 | 0 | 0 | 0 | 0 | 0 | 1 | 1 | 0 | 0 | High-order 8 bits of $C_2$, auxiliary frequency No. for lower keyboard |
| 0 | 0 | 0 | 0 | 0 | 0 | 1 | 1 | 0 | 1 | Low-order 8 bits of $C_2$, auxiliary frequency No. for lower keyboard |
| 0 | 0 | 0 | 0 | 0 | 0 | 1 | 1 | 1 | 0 | Unused area |
| 0 | 0 | 0 | 0 | 0 | 0 | 1 | 1 | 1 | 1 | Unused area |
| 0 | 0 | 0 | 0 | 0 | 1 | 0 | 0 | 0 | 0 | High-order 8 bits of $C\#_2$, note frequency No. |
| 0 | 0 | 0 | 0 | 0 | 1 | 0 | 0 | 0 | 1 | Low-order 8 bits of $C\#_2$, note frequency No. |
| 0 | 0 | 0 | 0 | 0 | 1 | 0 | 0 | 1 | 0 | High-order 8 bits of $C\#_2$, auxiliary frequency No. for upper keyboard |
| 0 | 0 | 0 | 0 | 0 | 1 | 0 | 0 | 1 | 1 | Low-order 8 bits of $C\#_2$, auxiliary frequency No. for upper keyboard |
| 0 | 0 | 0 | 0 | 0 | 1 | 0 | 1 | 0 | 0 | High-order 8 bits of $C\#_2$, auxiliary frequency No. for lower keyboard |
| 0 | 0 | 0 | 0 | 0 | 1 | 0 | 1 | 0 | 1 | Low-order 8 bits of $C\#_2$, auxiliary frequency No. for lower keyboard |
| 0 | 0 | 0 | 0 | 0 | 1 | 0 | 1 | 1 | 0 | Unused area |

Figure 1:
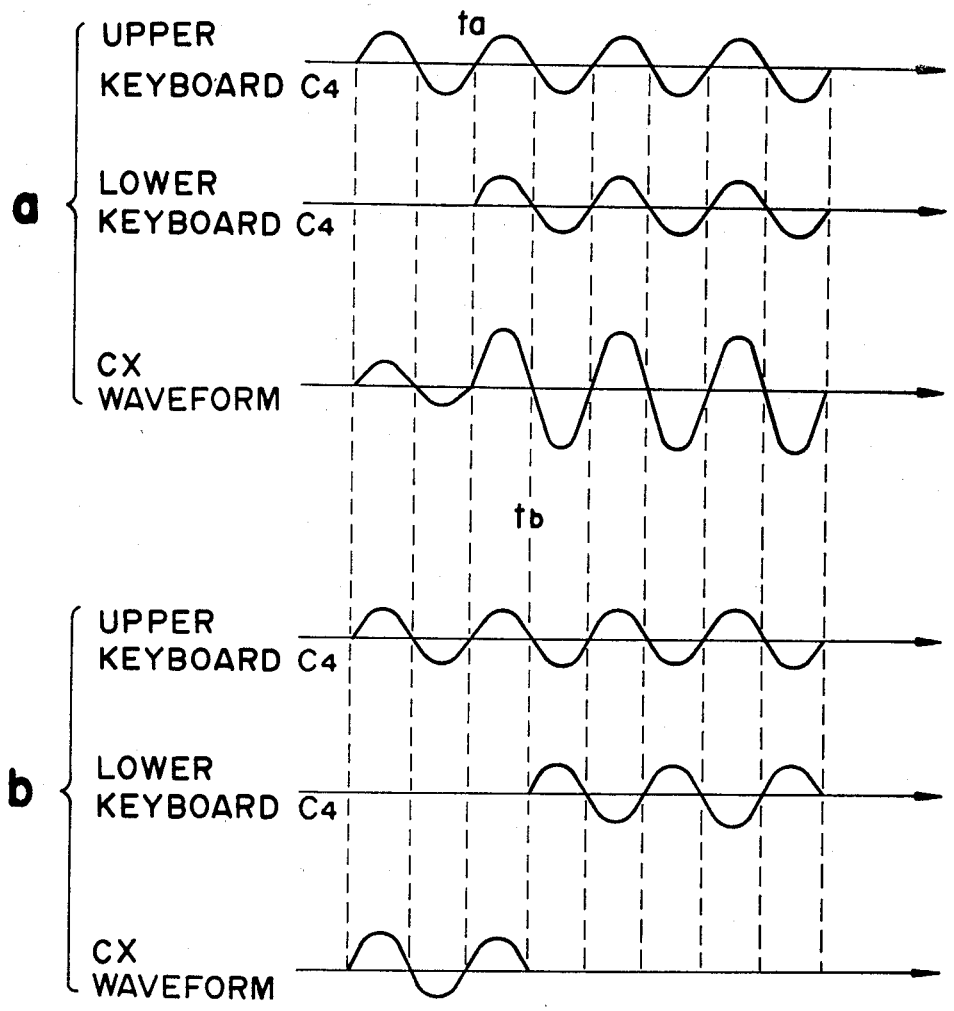
FIG. 1 is a diagram explanatory of problems encountered in the prior art.

As has been described in the foregoing, according to the present invention, a pair of frequency numbers consisting of a note frequency number corresponding to the pitch of each note and an auxiliary frequency number slightly different from the notes frequency number are provided for each note. Only when it is detected that keys of the same note are simultaneously depressed on different keyboards, musical waveform signals of slightly different pitches are produced. By this, when keys of different note are depressed on the keyboards, musical tones of standard pitches can be produced and only when the keys of the same note are simultaneously depressed on the keyboards, frequency numbers slightly differ, and, as a result of this, beat is generated to thereby average volume fluctuations of the composite waveform and minimize the defects of the prior art described previously in respect of FIG. 1.

It will be apparent that many modifications and variations may be effected without departing from the scope of the novel concepts of the present invention.

What is claimed is:

1. An electronic musical instrument including a plurality of keyboards in which a pair of frequency numbers consisting of a note frequency number corresponding to a pitch of a predetermined note and an auxiliary frequency number of a value slightly different from the value of the note frequency number are provided for each predetermined note and the frequency numbers are selected in accordance with predetermined key information, the electronic musical instrument comprising:

means for selecting the note frequency number for keys which are depressed on a plurality of keyboards when keys corresponding only to different notes are depressed on the plurality of keyboards;

means for detecting the keys simultaneously depressed on at least two keyboards are of the same note;

means for selecting the note frequency number for the one of the depressed keys;

means for selecting the auxiliary frequency number for the other depressed key in response to said means for detecting having detected simultaneously depressed keys of the same note on at least two keyboards; and means for reading out a musical waveform memory in accordance with the selected frequency numbers to generate musical waveform signals of slightly different pitches when the auxiliary frequency member is selected.

* * * * *